United States Patent [19]

Mielke et al.

[11] Patent Number: 5,063,894

[45] Date of Patent: Nov. 12, 1991

[54] PRESSURE-DIECAST LIGHT-ALLOY PISTON FOR INTERNAL COMBUSTION ENGINES

[75] Inventors: Siegfried Mielke, Neckarsulm; Wolfgang Henning, Obersulm; Franz Weiss, Neckarsulm; Karl Gölder, Obersulm, all of Fed. Rep. of Germany

[73] Assignees: Kolbenschmidt Aktiengesellschaft, Neckarsulm, Fed. Rep. of Germany; Nissan Motor Co. Ltd., Yokusuka; Atsugi Motor Parts Co. Ltd., Atsugi, both of Japan

[21] Appl. No.: 609,294

[22] Filed: Nov. 5, 1990

[30] Foreign Application Priority Data

Nov. 11, 1989 [DE] Fed. Rep. of Germany ..... 3937616

[51] Int. Cl.[5] ..... F02F 3/00

[52] U.S. Cl. ..... 123/193 P; 92/222; 92/223; 92/224

[58] Field of Search ..... 123/193 P; 92/212, 213, 92/222, 223, 224

[56] References Cited

U.S. PATENT DOCUMENTS

| | | | |
|---|---|---|---|
| 3,596,571 | 8/1971 | Hill et al. | 123/193 P |
| 3,911,891 | 10/1975 | Dowell | 92/224 |
| 4,643,078 | 2/1987 | Ban | 92/224 |
| 4,677,901 | 7/1987 | Ban et al. | 123/193 P |
| 4,798,770 | 1/1989 | Donomoto et al. | 123/193 P |
| 4,909,133 | 3/1990 | Taylor et al. | 92/212 |
| 4,920,864 | 5/1990 | Skingle et al. | 92/224 |

*Primary Examiner*—Andrew M. Dolinar
*Assistant Examiner*—M. Macy
*Attorney, Agent, or Firm*—Sprung Horn Kramer & Woods

[57] ABSTRACT

In a pressure-diecast light-alloy piston for internal combustion engines, which piston comprises shaped fibrous bodies which are partly embedded in at least one of the piston head, ring zone, piston pin bosses and skirt of the piston, which bodies comprise short ceramic fibers, lying in a common plane and in said plane having a random orientation, the improvement wherein the piston (1) is made of a high-temperature magnesium alloy, the piston skirt at least on its sliding surfaces has a chemically applied or electrodeposited metallic sliding layer (3) which has a thickness of about 10 to 30 μm and a hardness of about 740 to 850 $HV_{0.01}$, and the inside surface of the piston is coated with a thin plastic paint layer (2) or an anodized magnesium oxide layer.

10 Claims, 1 Drawing Sheet

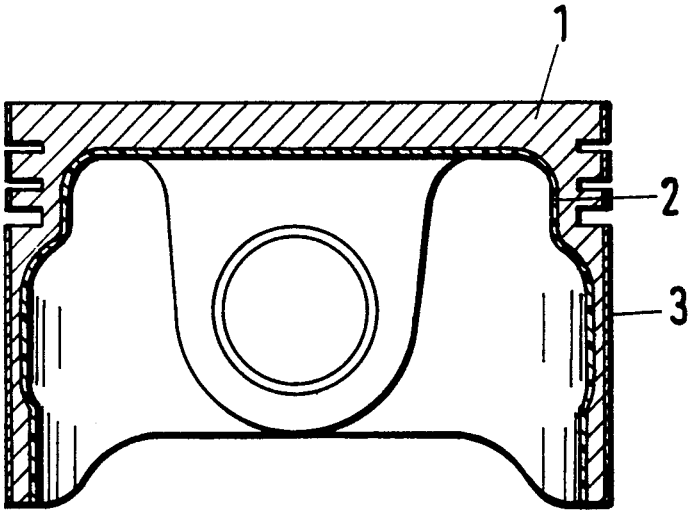
1
2
3

PRESSURE-DIECAST LIGHT-ALLOY PISTON FOR INTERNAL COMBUSTION ENGINES

This invention relates to a pressure-diecast light-alloy piston for internal combustion engines, which piston comprises shaped fibrous bodies, which are partly embedded in the piston head, ring zone, piston pin bosses and/or skirt of the piston and consist of short ceramic fibers, particularly of alumna, silicon carbide or silicon nitrite, and extend parallel to a plane and in said plane have a random orientation.

The desire for internal combustion engines which has a low fuel consumption, low noise and low vibration has increased the requirements to be met by the light-alloy pistons. The approaches which may be adopted to meet said requirements include a decrease of the mass of the piston because this will result in a decrease of the weight of the internal combustion engines so that the weight of the vehicle is decreased and the fuel consumption is decreased too. A smaller piston mass will excite less vibrations in the internal combustion engine and will result in a more favorable behavior as regards acoustic vibrations so that the comfort will be improved.

In addition to the endeavors to distinctly decrease the mass of the piston in the piston pin bosses, the ring zone and the piston head by a reduction of the compression height of the piston and a decrease of the length of the piston skirt, the fact that magnesium and its alloys have a relatively low density has always stimulated attempts to use pistons made from magnesium or its alloys in internal combustion engines for trial operations. It has been intended to use the lighter pistons in order to reduce the oscillating masses in the internal combustion engine and to reduce the bearing pressures. However, in comparison to the aluminum-silicon alloys usually employed for the manufacture of light-alloy pistons for internal combustion engines, magnesium materials have considerable disadvantages. Because of their wear under the conditions of mixed friction existing during the starting, running-in and emergency running operations of the engine, the life of pistons made of magnesium materials is relatively low in view of the dynamic stresses which are due to the gas forces.

In order to improve the wear resistance it has been proposed in DE 20 46 862 A to provide on the sliding surface of a piston made of magnesium material a low-friction layer which consists of a wear-resisting metal, such as chromium, and which is firmly bonded to the piston body by means of an aluminum interlayer. It is also known to provide the sliding surface with a wear-resisting coating consisting of an aluminum alloy, iron, graphite, manganese, nickel, tin, lead, cadmium and zinc or to use alloys consisting of magnesium and wear-resisting elements, such as aluminum or silicon. In order to increase the strength, alloys are used which contain magnesium, cerium and thorium, and the piston is made by forging operations in which the directions of fibers are suitably controlled (Company publication: Mahle KG and Electron-Co. mbH, Stuttgart-Bad Cannstadt, 1946). However, all said measures have not been sufficient thus far to provide pistons which are made of magnesium materials and are functionally satisfactory in internal combustion engines. Whereas JP 63-042 38 A discloses for use in internal combustion engines a piston which consists of a magnesium alloy that is reinforced with 3 to 30% by volume alumna-silica fibers, such light-alloy pistons have not yet been adopted in practice because they subject the sliding surface of the cylinder to a relatively high abrasive wear.

It is an object of the present invention to provide for internal combustion engines a pressure-diecast light-alloy piston which is of the kind described first hereinabove and which has sufficient wear resistance and low friction and which, particularly in internal combustion engines having a very high specific power output, has the high strengths required under the dynamic stresses which are due to the gas forces.

That object is accomplished in that the piston is made of a high-temperature magnesium alloy, the piston skirt has at least on its sliding surfaces a chemically applied or electrodeposited metallic sliding layer, which has a thickness of 10 to 30 $\mu$m and a hardness of 740 to 850 $HV_{0.01}$, and the inside surface of the piston is coated with a thin plastic paint layer, e.g. a duroplastic such as an acrylate.

Because the selectively fiber-reinforced light-alloy piston is made by pressure diecasting from a magnesium alloy, the magnesium alloy has a fine structure and, as a result, a high resistance to temperature shock. The use of preformed fibrous bodies results in higher strengths, lower thermal expansion and a higher modulus of elasticity. In accordance with a further feature of the invention the materials of the sliding layer may particularly consist of nickel, cobalt, chromium, iron, nickel with cobalt inclusions or nickel with chromium inclusions. Said materials have a high wear resistance and firmly adhere to the magnesium material of the piston body. Only under extremely high stresses which are due to the gas forces may it be desirable to bond the metallic sliding layer by a copper interlayer to the magnesium material of the piston body.

In accordance with a further feature of the invention the metallic sliding layer may contain included particles of nonmetallic hard materials, such as silicon carbide or the like, or of ceramic oxide materials, such as chromium oxide or the like, so that the wear resistance is additionally increased.

In accordance with a further feature of the invention the thin plastic paint layer provided on the inside surface of the piston has been replaced entirely or in part by a magnesium oxide layer produced by anodizing.

A magnesium alloy which contains 2 to 6% by weight, preferably 3.5 to 5.5% by weight, neodymium is particularly desirable for the purpose of the invention. The magnesium alloy may optionally also contain 0.5 to 7.5% by weight yttrium so that a higher precipitation hardening can be achieved.

The invention will be explained in more detail by way of example with reference to the accompanying drawing which is a longitudinal sectional view, which is taken on the plane which contains the piston axis and the axis that is at right angles to the direction of the piston pin axis.

The FIGURE shows a piston 1 which has been made by pressure diecasting from a magnesium alloy having the composition $Mg^5Nd$. The skirt of the piston is reinforced with 20% by volume alumna fibers and is coated with a chemically deposited nickel layer 3 having a thickness of 16 to 24 $\mu$m and is coated on its inside surface with an acrylate paint layer 2 having a thickness of 15 $\mu$m. The relatively smooth nickel layer has neither pores nor cracks in the layer itself nor in the bonding zone adjoining the magnesium alloy of the piston body. The nickel layer has an average hardness of 740 to 770

$HV_{0.010}$. to test the bond strength of the nickel layer, it was blasted with glass beads for 20 seconds. Delamination of the nickel layer was not observed.

It will be understood that the specification and examples are illustrative but not limitative of the present invention and that other embodiments within the spirit and scope of the invention will suggest themselves to those skilled in the art.

What is claimed is:

1. In a pressure-diecast light-alloy piston for internal combustion engines, which piston comprises shaped fibrous bodies which are partly embedded in at least one of the piston head, ring zone, piston pin bosses and skirt of the piston, which bodies comprise short ceramic fibers, lying in a common plane and in said plane having a random orientation, the improvement wherein the piston (1) is made of a high-temperature magnesium alloy, the piston skirt at least on its sliding surfaces has a chemically applied or electrodeposited metallic sliding layer (3) which has a thickness of about 10 to 30 μm and a hardness of about 740 to 850 $HV_{0.01}$, and the inside surface of the piston is coated with a thin plastic paint layer (2) or an anodized magnesium oxide layer.

2. A light-alloy piston according to claim 1, wherein the sliding layer (3) comprises nickel, cobalt, chromium, iron, nickel with cobalt inclusions, or nickel with chromium inclusions.

3. A light-alloy piston according to claim 1, wherein particles of a non-metallic hard material are included in the sliding layer (3).

4. A light-alloy piston according to claim 3, wherein the non-metallic hard material comprises silicon carbide.

5. A light-alloy piston according to claim 1, wherein particles of ceramic oxide materials are included in the sliding layer (3).

6. A light-alloy piston according to claim 5, wherein the ceramic oxide comprises chromium oxide.

7. A light-alloy piston according to claim 1, wherein the magnesium alloy contains about 2 to 6% by weight of neodymium.

8. A light-alloy piston according to claim 7, wherein the magnesium alloy contains about 3.5 to 5.5% by weight of neodymium.

9. A light-alloy piston according to claim 8, wherein the magnesium alloy also contains about 0.5 to 7.5% by weight of yttrium.

10. A light-alloy piston according to claim 1, wherein the ceramic fibers comprise at least one of alumna, silicon carbide and silicon nitride.

* * * * *

UNITED STATES PATENT AND TRADEMARK OFFICE

CERTIFICATE OF CORRECTION

PATENT NO. : 5,063,894

DATED : November 12, 1991

INVENTOR(S) : Mielke et al.

It is certified that error appears in the above-identified patent and that said Letters Patent is hereby corrected as shown below:

| | | |
|---|---|---|
| Col. 1, line 10 | Delete "alumna" | and substitute -- alumina -- |
| Col. 1, last line | Delete " alumna " | and substitute -- alumina -- |
| Col. 2, line 61 | Delete " alumna " | and substitute -- alumina -- |
| Col. 4, line 24 | Delete " alumna " | and substitute -- alumina -- |

Signed and Sealed this

Sixth Day of July, 1993

*Attest:*

Michael K. Kirk

MICHAEL K. KIRK

*Attesting Officer*

*Acting Commissioner of Patents and Trademarks*